US011763705B2

(12) United States Patent
D'Amico

(10) Patent No.: US 11,763,705 B2
(45) Date of Patent: Sep. 19, 2023

(54) FLAG DEMONSTRATION APPARATUS

(71) Applicant: Thomas D'Amico, West Bend, WI (US)

(72) Inventor: Thomas D'Amico, West Bend, WI (US)

( * ) Notice: Subject to any disclaimer, the term of this patent is extended or adjusted under 35 U.S.C. 154(b) by 274 days.

(21) Appl. No.: 17/230,055

(22) Filed: Apr. 14, 2021

(65) Prior Publication Data

US 2021/0375168 A1 Dec. 2, 2021

Related U.S. Application Data

(60) Provisional application No. 63/031,569, filed on May 29, 2020.

(51) Int. Cl.
*G09F 17/00* (2006.01)

(52) U.S. Cl.
CPC .... *G09F 17/0091* (2013.01); *G09F 2017/005* (2013.01)

(58) Field of Classification Search
CPC ..... G09F 17/0091; G09F 2017/005
See application file for complete search history.

(56) References Cited

U.S. PATENT DOCUMENTS 1,022,360 A * 4/1912 Fitzsimons ..... G09F 17/00 116/174
1,253,380 A 1/1918 Hoffman
1,311,712 A * 7/1919 Power ..... G09F 17/00 116/174
1,855,824 A * 4/1932 Crichton ..... E04H 12/32 116/173
2,507,623 A * 5/1950 Diaz ..... E04H 12/32 248/910
2,965,991 A * 12/1960 Simmons ..... G09F 7/22 D20/19
3,083,431 A * 4/1963 Lewis ..... F16B 45/02 24/599.7
3,706,297 A 12/1972 Voorhees
5,375,555 A 12/1994 Dolan
5,522,342 A 6/1996 Chen-Chao
(Continued)

FOREIGN PATENT DOCUMENTS

CN 2486665 Y 4/2002

OTHER PUBLICATIONS

Neverfurl.com, Neverfurl Installation Kit, last accessed Mar. 17, 2021, date of publication unknown.

(Continued)

*Primary Examiner* — John Fitzgerald
*Assistant Examiner* — Tania Courson

(57) ABSTRACT

A flag demonstration apparatus which prevents flag furling is provided. The apparatus comprises a flagpole which further comprises a bottom portion and a top portion that removably fasten together and sandwich a lower swivel bracket. The apparatus also includes an upper bracket attached near the top of the top portion of the flagpole and is attached to at least one portion of a flag and the lower swivel bracket is attached to at least two portions of the flag. The lower swivel bracket allows the flag to rotate less than 360 degrees about the flagpole and also keeps at least a portion of the flag displayed, regardless of environmental conditions.

13 Claims, 6 Drawing Sheets

(56) References Cited

U.S. PATENT DOCUMENTS

| | | | | | |
|---|---|---|---|---|---|
| 5,572,835 | A * | 11/1996 | Atkins | G09F 17/00 | 248/407 |
| 5,697,321 | A | 12/1997 | Dobbins | | |
| 5,806,819 | A * | 9/1998 | Martone | F16B 2/22 | 248/230.1 |
| 6,334,596 | B1 * | 1/2002 | Temple | G09F 17/00 | 248/156 |
| D455,642 | S * | 4/2002 | Kelleghan | D8/367 | |
| 6,402,116 | B1 | 6/2002 | Northup | | |
| 6,845,730 | B2 * | 1/2005 | Cardarelli | G09F 17/00 | 116/173 |
| 6,923,141 | B1 * | 8/2005 | Staats | G09F 17/00 | 116/173 |
| D520,345 | S * | 5/2006 | Kelleghan | D8/356 | |
| 7,788,835 | B2 * | 9/2010 | Venn | G09F 15/0087 | 40/604 |
| 8,069,811 | B2 * | 12/2011 | Ciaccia | G09F 17/00 | 116/173 |
| 8,695,252 | B2 * | 4/2014 | Urbina | G09F 17/00 | 40/607.01 |
| 8,973,517 | B1 * | 3/2015 | Bort | G09F 17/00 | 362/183 |
| 9,972,227 | B2 * | 5/2018 | Evans | G09F 19/12 | |
| 10,074,296 | B2 * | 9/2018 | Lyons | G09F 17/00 | |
| 10,850,209 | B2 * | 12/2020 | Xu | F21L 4/08 | |
| 11,475,806 | B2 * | 10/2022 | Coates | G09F 17/00 | |
| 11,488,502 | B2 * | 11/2022 | Klevana | G09F 17/00 | |
| 2005/0199176 | A1 | 9/2005 | Orton et al. | | |
| 2007/0044703 | A1 * | 3/2007 | Vickroy | G09F 17/00 | 116/173 |
| 2012/0111259 | A1 | 5/2012 | Swisher et al. | | |
| 2012/0210930 | A1 * | 8/2012 | Lupoff | G09F 21/04 | 116/173 |

OTHER PUBLICATIONS

Flyrite.com, Assembly Instructions, last accessed Mar. 17, 2021, date of publication unknown.

FlagsExpress.com, Capitol Flag Set w/ Aluminum Rotating Pole, last accessed Mar. 17, 2021, first publication Mar. 4, 2006.

FlagsExpress.com, Non-Tangle Avenue Flag Set, last accessed Mar. 23, 2021, first publication Jul. 31, 2020.

* cited by examiner

FLAG DEMONSTRATION APPARATUS

CROSS REFERENCE TO RELATED APPLICATIONS

U.S. Provisional application No. 63/031,569, filed on May 29, 2020.

BACKGROUND OF THE INVENTION

The present invention relates to a system and apparatus for displaying flags and preventing them from furling. Presently there are numerous problems with the existing technology in the flag industry. First, due to environmental conditions, flags naturally furl or wrap around the flagpole they are attached to. Unfurling flags often requires specialized equipment, risk to personnel, and additional cost to remedy. In addition, many city governments and businesses have to purchase new flags prematurely due to flags regularly rubbing against supporting light posts when there is no wind keeping the flag flying and away from the post. Last, when there is no wind a flag often droop, preventing display of the flag. There is a need for solutions and the present invention solves all of these problems by providing a solution which keeps a flag from furling, prevents a flag from premature degradation by keeping the flag away from support structures and displays at least a portion of the flag regardless of the environmental conditions.

SUMMARY OF THE INVENTION

A possible object of the invention is to prevent flag furling.

Another possible object of the invention is to prolong the life of a flag.

Another possible object of the invention is to display at least a portion of the flag regardless of environmental conditions.

Another possible object of the invention is to provide an apparatus that does not require tools install or change the flag.

The invention relates, in one embodiment to a flag demonstration apparatus including a flagpole which further comprises a bottom portion with a first fastening end and a first terminating end and a top portion with a second fastening end and a second terminating end, an upper bracket removably attached near the second terminating end, and a lower swivel bracket sandwiched between the first fastening end of the bottom portion and the second fastening end of the top portion which allows the lower swivel bracket to rotate about the flagpole less than 360 degrees.

The invention relates, in another embodiment to a system for a flag demonstration apparatus comprising a flag with at least two grommets, a flagpole further comprising a bottom portion with a first fastening end and a first terminating end, a top portion with a second fastening end and a second terminating end, a lower rotatable bracket sandwiched between the first fastening end and the second fastening end and an upper bracket attached to the second terminating end, the upper bracket is removably attached to one grommet of the flag and the lower rotatable bracket is removably attached to the second grommet of the flag and a portion of the flag, the lower rotatable bracket is configured to rotate about the flagpole less than 360 degrees.

The invention relates, in another embodiment to a swivel bracket comprising a rotatable flag hook further comprising a base with an aperture and canal formed therethrough, a rod, a clamp and a clamp screw wherein the flag hook is configured to attach to a grommet of a flag and is fixed to one end of the rod while the clamp is fixed to the other end of the rod. Further, the clamp screw is removably attached to the clamp and configured to cause the clamp to securely hold a portion of the flag.

DETAILED DESCRIPTION OF THE INVENTION

Figure 1:
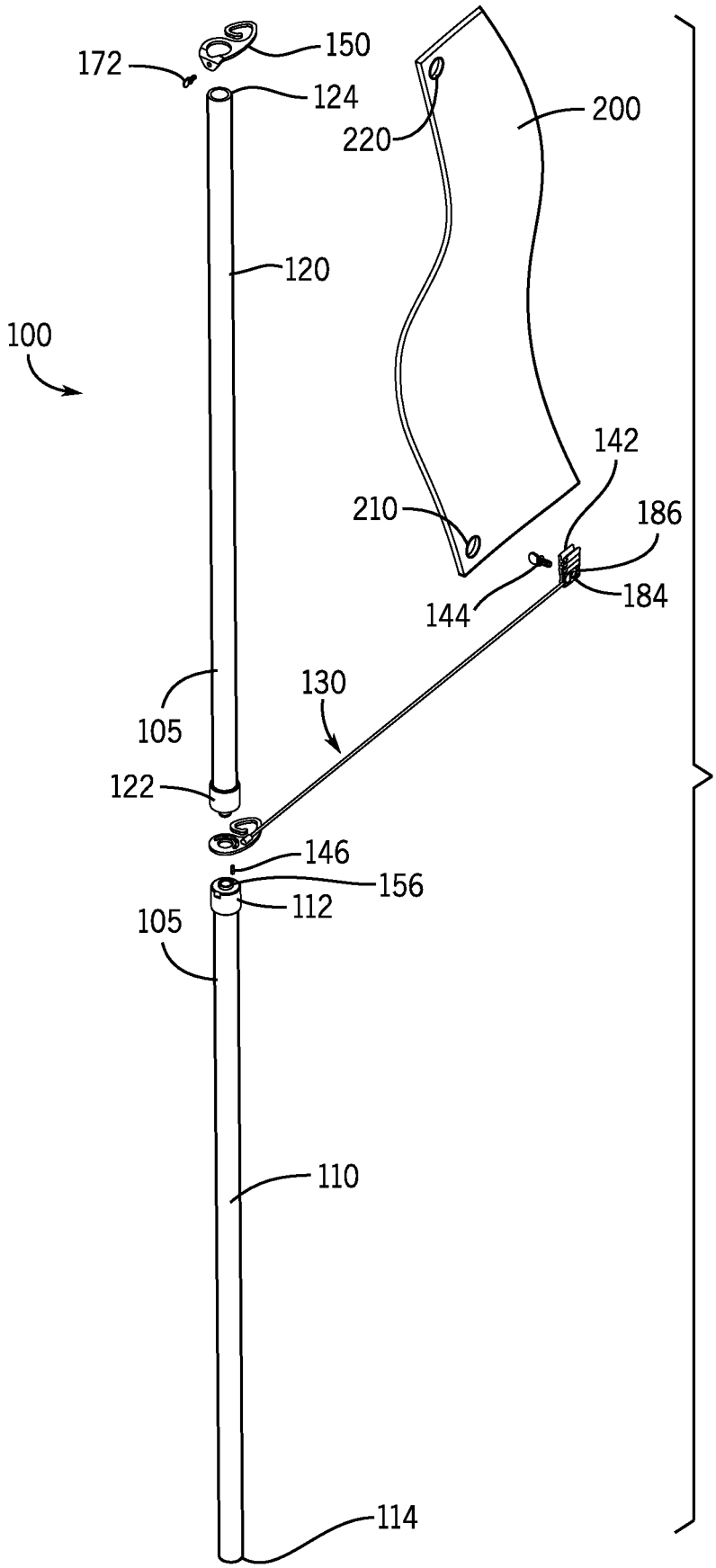
FIG. 1. is an isometric exploded view of an embodiment of the present invention.

A flag demonstration apparatus will now be described with references in FIGS. 1-6. Turning to the drawings, where the reference characters indicate corresponding elements throughout the several figures, attention is first directed to FIG. 1 where an isometric exploded view of an embodiment of the flag demonstration apparatus is shown, illustrating its composition and the apparatus is generally indicated by reference character 100. Flag demonstration apparatus 100 is comprised of a flagpole 105 with a bottom portion 110, a top portion 120, a lower swivel bracket 130 and an upper bracket 150. Bottom portion 110 further comprises a first fastening end 112 with a pin 146 and circular ridge 156 affixed to said end and a first terminating end 114. Top portion 120 further comprises a second fastening end 122 and a second terminating end 124. First fastening end 112 and second fastening end 122 removably attach together, sandwiching lower swivel bracket 130 between first fastening end 112 and second fastening end 122, thereby allowing lower swivel bracket 130 to freely rotate less than 360 degrees about flagpole 105. Although not required, apparatus 100 may further comprise a finial or adornment attached to second terminating end 124 (see FIG. 6). While an adornment is generally ornamental, it may also be a functional component, such as a flag illumination device. Flag 200 includes a first grommet 210 and second grommet 220 where first grommet 210 attaches to lower swivel bracket 130 and second grommet 220 attaches to upper bracket 150. Lower swivel bracket 130 is further attached to flag 200 by clamp 142, which holds flag 200 extended away from flagpole 105 in a perpendicular manner, thereby displaying at least a portion of the flag even when wind is not present or regardless of the environmental conditions. Further, upper bracket 150 holds the top portion of flag 200 stationary while lower swivel bracket 130 allows the lower section of flag 200 to rotate about flagpole 105 less than 360 degrees, and preferably 180 degrees, thereby allowing flag 200 to move due to wind but also prevents flag 200 from furling or wrapping around flagpole 105, thereby reducing potential damage to flag 200 as well as or the need for repeated manual intervention to unfurl flag 200. In the preferred embodiment bottom portion 110 is 85.73 cm (33.75 inches) long and 25 mm in diameter with first fastening end 112 measuring 28.58 mm long and 32 mm in diameter; while top portion 120 is 98.43 cm (38.75 inches) long and 25 mm in diameter and second fastening end 122 is 28.58 mm long and 32 mm in diameter, but flagpole 105 including bottom portion 110 and top portion 120 may be any desired dimensions. Further, it is contemplated first fastening end 112 may be permanently attached, formed integral with or removably attached to bottom portion 110 and second fastening end 122 may be permanently attached, formed integral with or removably attached to top portion 120. In addition, flagpole 105 along with bottom portion 110 and top portion 120 are generally cylindrical but could be another shape such as a square tube, if desired.

Figure 2:
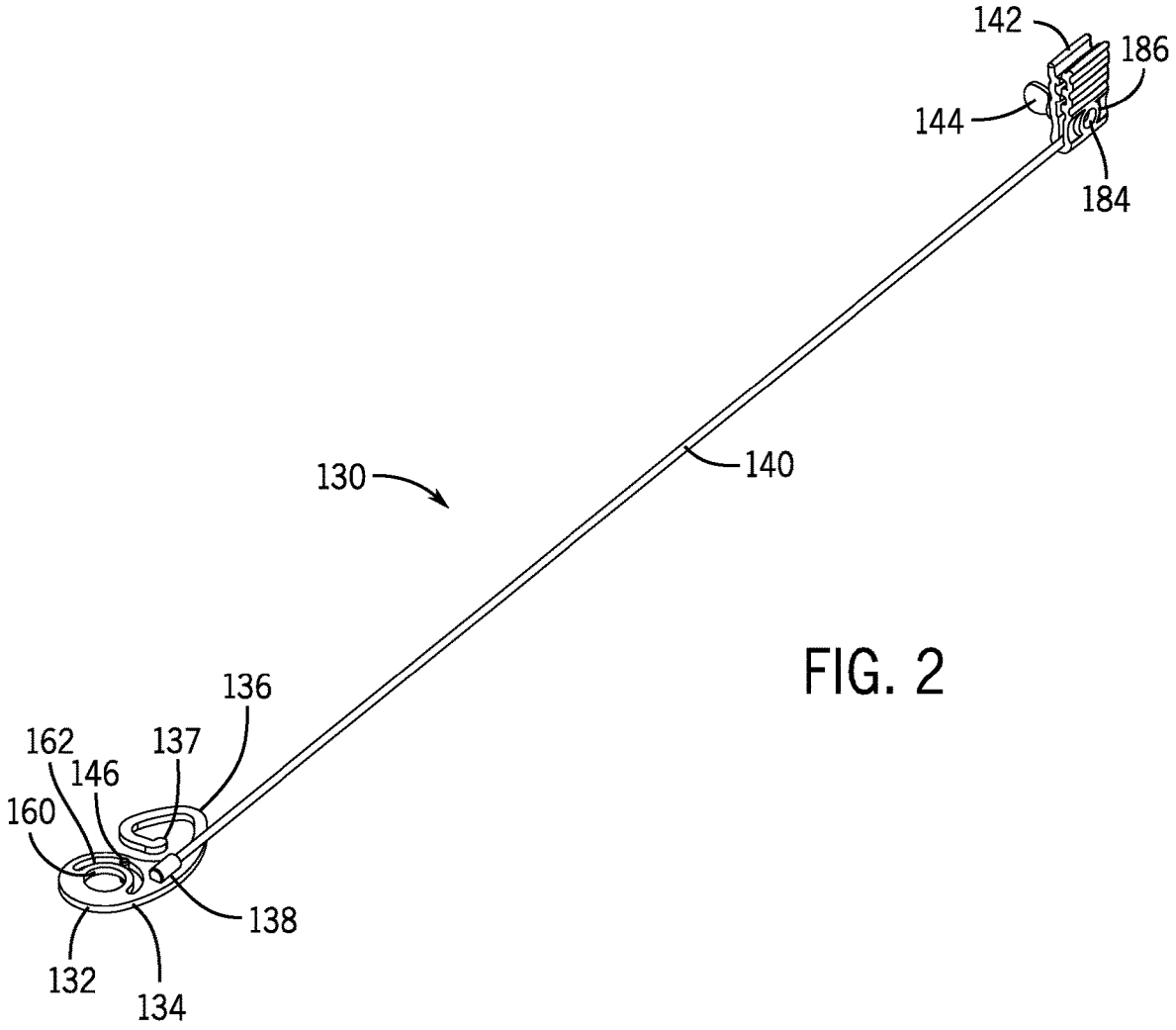
FIG. 2. is a top perspective view of lower swivel bracket 130.

Turning to FIG. 2, a top perspective view of lower swivel bracket 130 is shown. Lower swivel bracket 130 attaches to at least two portions of a flag and is comprised of a flag hook 132, rod 140, clamp 142 and clamp screw 144. Flag hook 132 is further comprised of a base 134 generally circular in shape on one side and a hook 136 on the opposing side. Flag hook 132 further comprises a rod socket 138 affixed to and may extend away from the top or bottom surface of flag hook 132, located where base 134 and hook 136 meet and configured to securely hold rod 140 such as by glue or an interference fit. Hook 136 further comprises tip 137 which is configured to extend through first grommet 210 of flag 200 and to secure and maintain first grommet 210 within the interior of hook 136 until first grommet 210 is disengaged from hook 136 manually by a user. Hook 136 and tip 137 are configured to allow a user to engage and disengage first grommet 210 without the need for special tools. Base 134 further comprises a circular aperture 160 formed therethrough and located centrally in base 134 and a canal 162, semi-circular in shape and located around the upper perimeter of circular aperture 160 and equidistant between the top edge of circular aperture 160 and top edge of base 134. Circular aperture 160 is larger in diameter than circular ridge 156 (described below and see FIG. 3) and allows lower swivel bracket 130 to rotate about circular ridge 156 on first fastening end 112 of bottom portion 110. Canal 162 is a width at least equal to the diameter of pin 146 (which is affixed to first fastening end 112) and limits the ability of lower swivel bracket 130 to rotate to less than 360 degrees about flagpole 105. In the preferred embodiment the shape of semi-circular canal 162 is configured to allow lower swivel bracket 130 to rotate 180 degrees in total. However, if desired canal 162 may be greater than or less than semi-circular in shape, width and/or length around circular aperture 160 to allow for greater or reduced rotation with an upper limit of less than 360 degrees. Flag hook 132 is ideally made of steel but any rigid or semi-rigid material such as metal, plastic, nylon, Kevlar, fiberglass or carbon fiber may be used which is sturdy and will hold up to seasonal weather conditions at least in the United States. In the preferred embodiment Flag hook 132 is 74 mm long, 37 mm wide and 3 mm thick, but the size and proportions may be adjusted to accommodate different flag sizes, weights, grommet type and dimensions or flagpole diameters and lengths. Rod 140 is ideally made of fiberglass but any flexible and strong material may be used such as carbon fiber, Kevlar or metal. In the preferred embodiment rod 140 is 3 mm in diameter and 60.96 cm (24 inches) long but the size characteristics may be adjusted to accommodate the desired flag size and weight.

Figure 3:
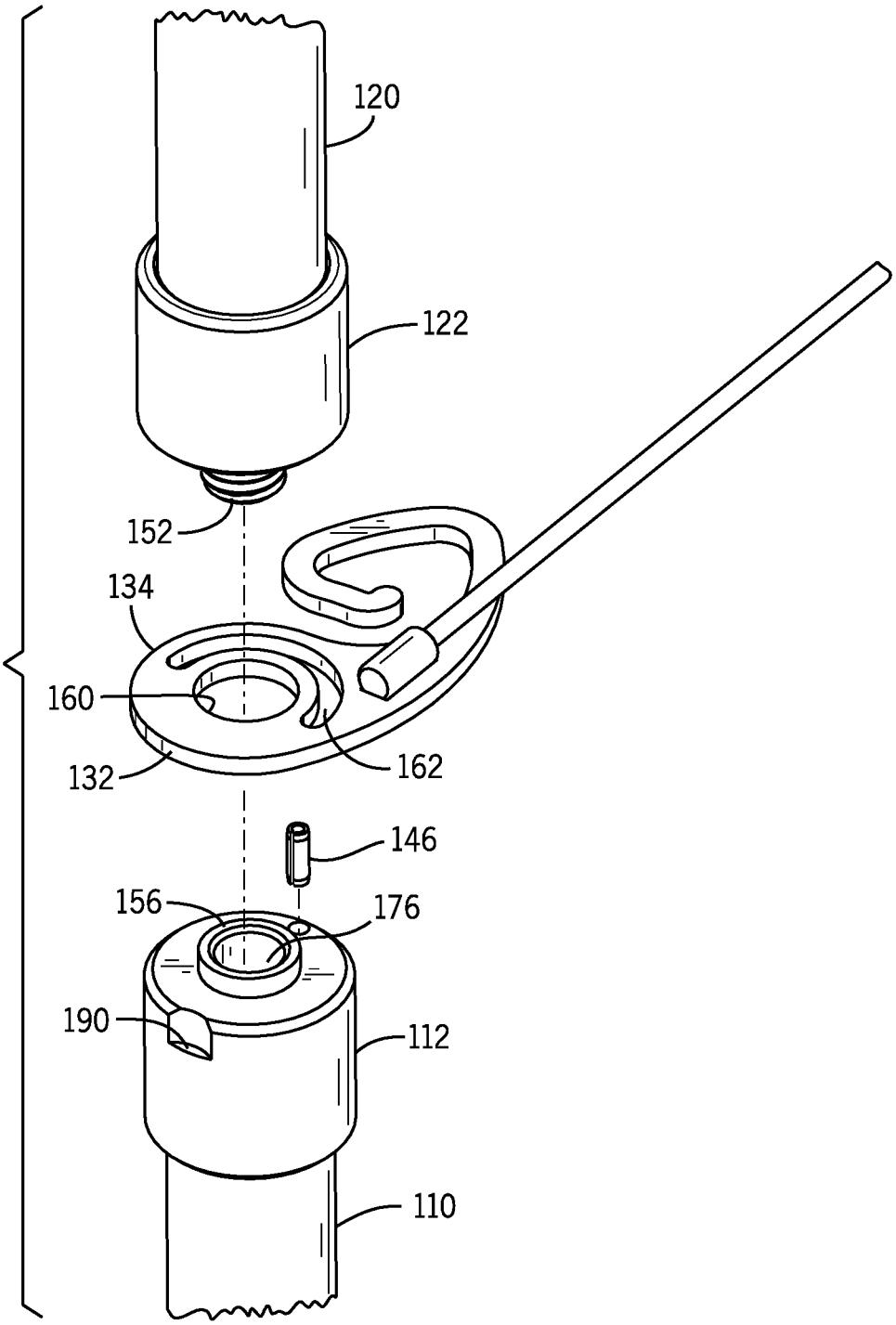
FIG. 3. is a magnified front perspective view of an embodiment of the present invention.

Turning to FIG. 3, a magnified front perspective view of an embodiment of the present invention is shown, exemplifying how lower swivel bracket 130 is sandwiched between first fastening end of 112 bottom portion 110 and second fastening end 122 of top portion 120 of flagpole 105. Second fastening end 122 is affixed to top portion 120 of flagpole 105 and further comprises post 152 located centrally on the top side of second fastening end 122. In the preferred embodiment post 152 is 13 mm in diameter, 12 mm tall and threaded. First fastening end 112 is affixed to bottom portion 110 and further comprises circular ridge 156 formed integral with first fastening end 112, located centrally on the top side of first fastening end 112 and surrounding an interior cavity 176. Interior cavity 176 is configured to receive post 152 and extends into first fastening end 112 so the total width and depth of interior cavity 176 is at least the width and length/height of post 152. In the preferred embodiment interior cavity 176 is threaded with an opposite thread pitch of post 152 so post 152 can screw into interior cavity 176, thereby securing bottom portion 110 and top portion 120 of flagpole 105 together. Circular ridge 156 is a height which allows flag hook 132 to rotate freely while simultaneously allowing bottom portion 110 and top portion 120 of flagpole 105 to securely fasten together, in the preferred embodiment ridge 156 is at least 3 mm tall to accommodate flag hook 132 with a thickness of 3 mm. In addition, it is desirable to choose a circular ridge 156 height which prevents flag hook 132 from wobbling while it rotates and also prevents debris from accumulating around the hook. Further, a pin 146 is attached to first fastening end 112 and extends away from and perpendicular to the top surface of end 112 at least 1 mm. In the preferred embodiment Pin 146 has a 3 mm diameter but the diameter and length may be adjusted in proportion to adjustments in canal 162 and flag hook 132. Further, Pin 146 may be fixed to first fastening end 112 by adhesive, interference fit (by an opening made in top surface of end 112 a diameter no larger than that of pin 146) or could be made integral with first fastening end 112.

As mentioned above, aperture 160 of flag hook 132 is at least the outer diameter of circular ridge 156, 15 mm in the preferred embodiment, but ideally slightly larger (16 mm in the preferred embodiment) to allow for free rotation of flag hook 132 around circular ridge 156. Pin 146 is located equidistant between circular ridge 156 and the outside edge of first fastening end 112 and fits into canal 162 of flag hook 132, thereby providing a physical stop to limit the rotation of flag hook 132 rotating about circular ridge 156. Optionally, first fastening end 112 may also include a notch 190 formed therein and located inline with and opposite from pin 146 to provide a visual reference to a user in regard to pin location, thereby indicating the limits of rotation for flag hook 132 (and subsequently the rotation of bottom portion of any attached flag 200 which prevents furling of said attached flag 200 around flagpole 105).

Figure 4:
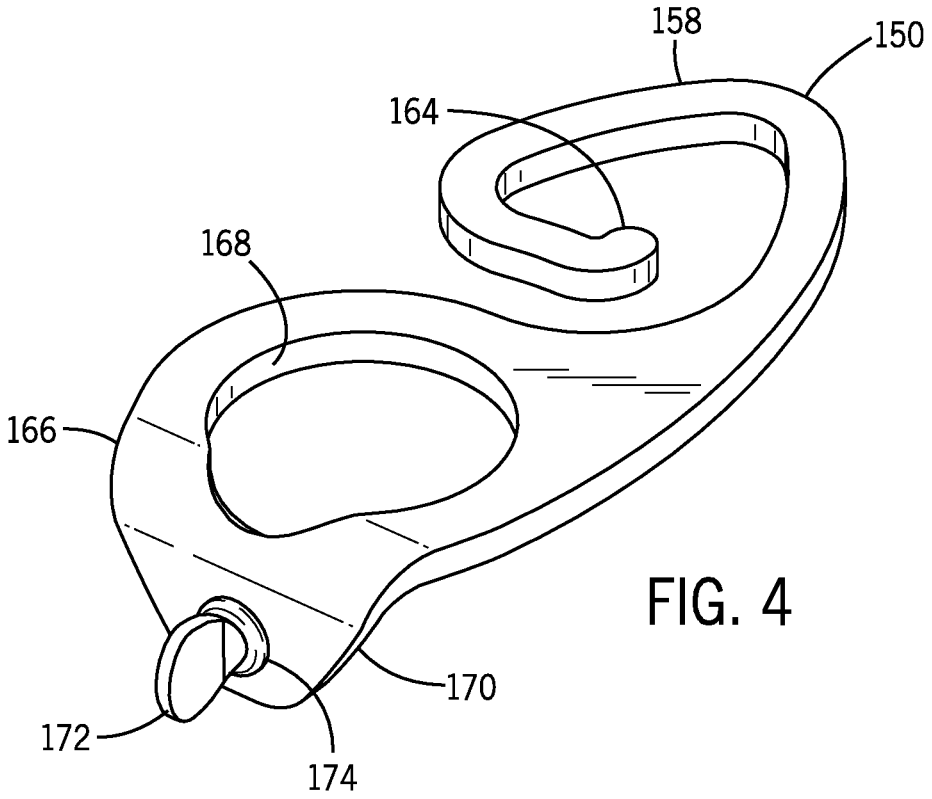
FIG. 4. is a top perspective view of upper bracket 150 of an embodiment of the present invention.

Turning to FIG. 4, a top perspective view of upper bracket 150 is shown. Upper bracket 150 secures the top portion of an attached flag 200 in a non-rotatable singular position on flagpole 105, generally at or near second terminating end 124, which further helps to prevent furling of an attached flag around flagpole 105. It is contemplated upper bracket may also be rotatable. Upper bracket 150 comprises upper bracket base 166, second hook 158 and second tip 164. Second tip 164 is configured to extend through grommet 220 of flag 200 and to secure and maintain grommet 220 within the interior of second hook 158 until grommet 220 is disengaged from second hook 158 manually by a user. Upper bracket base 166 further comprises a circular aperture 168 formed therethrough larger than the diameter of top portion 120 of flagpole 105 and a bent portion 170 configured perpendicular to the rest of upper bracket 150. Bent portion 170 further comprises set screw 172 which screws through a threaded opening 174 formed in bent portion 170 and extends to make contact with top portion 120, thereby securing upper bracket 150 to top portion 120. Upper bracket 150 is the same (or similar) outer shape, material and dimensions as flag hook 132 (including hook 136 and tip 137) except for bent portion 170 which in the current embodiment is 18 mm in length and is subject to change to accommodate varying flag weights, dimensions and flagpole characteristics. It is contemplated upper bracket 150 may be flipped over so bent portion 170 faces toward the top of flagpole 150 instead of toward the bottom.

Figure 5:
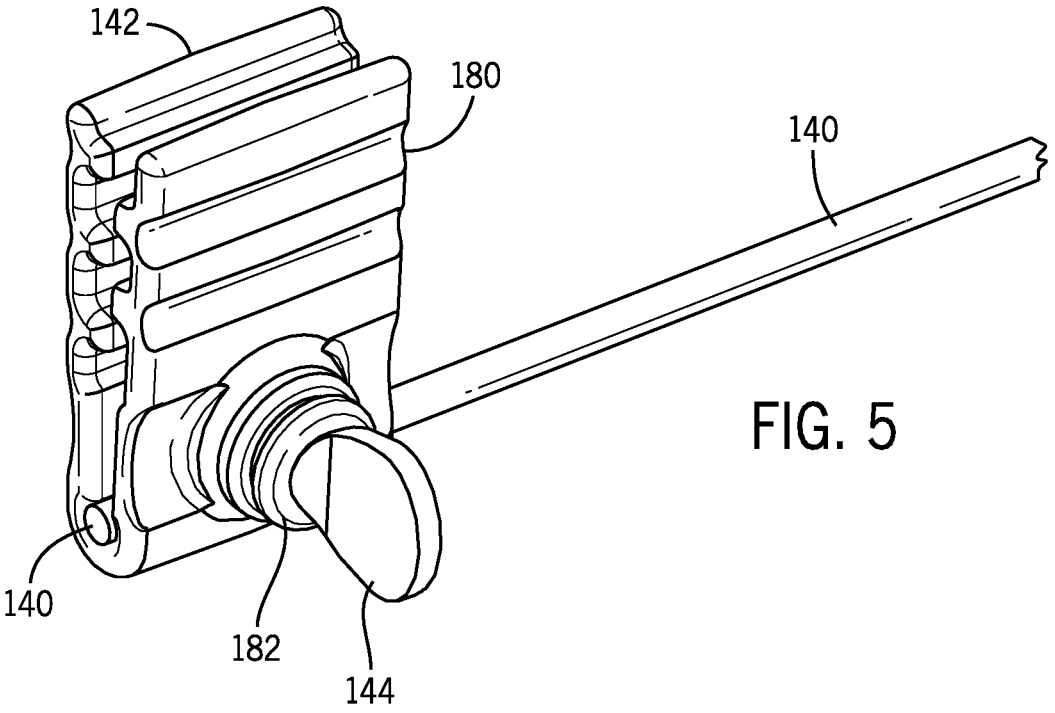
FIG. 5. is a perspective view of clamp 142 of an embodiment of the present invention.

Turning to FIG. 5, a perspective view of clamp 142 is shown. Clamp 142 is a "U" shape and further comprises rounded ridges 180 formed integrally with clamp 142, a first aperture 182 formed therein located on one side of the "U" shape, a second aperture 186 (see FIG. 2) formed therein located on other side of the "U" shape where apertures 182 and 186 are located inline with one-another, nut 184 secured inside aperture 186 (see FIG. 2) and screw 144, wherein screw 144 extends through aperture 182 and is configured to screw into nut 184 located inside aperture 186, thereby squeezing both sides of clamp 142 together when screw 144 is tightened, gently securing a segment of flag 200 between ridges 180 without damaging the flag fabric. In addition, rod 140 extends through the bottom of the "U" shape and is adhered to clamp 142 by adhesive or interference fit. In the preferred embodiment clamp is 40 mm tall, 26 mm wide and 3 mm thick with ridge 180 height of at least 1 mm and made of semi-rigid material such as rubber, nylon or plastic but any semi-rigid material may be used in a ratio which accommodates the desired flag dimensions and weight.

Figure 6:
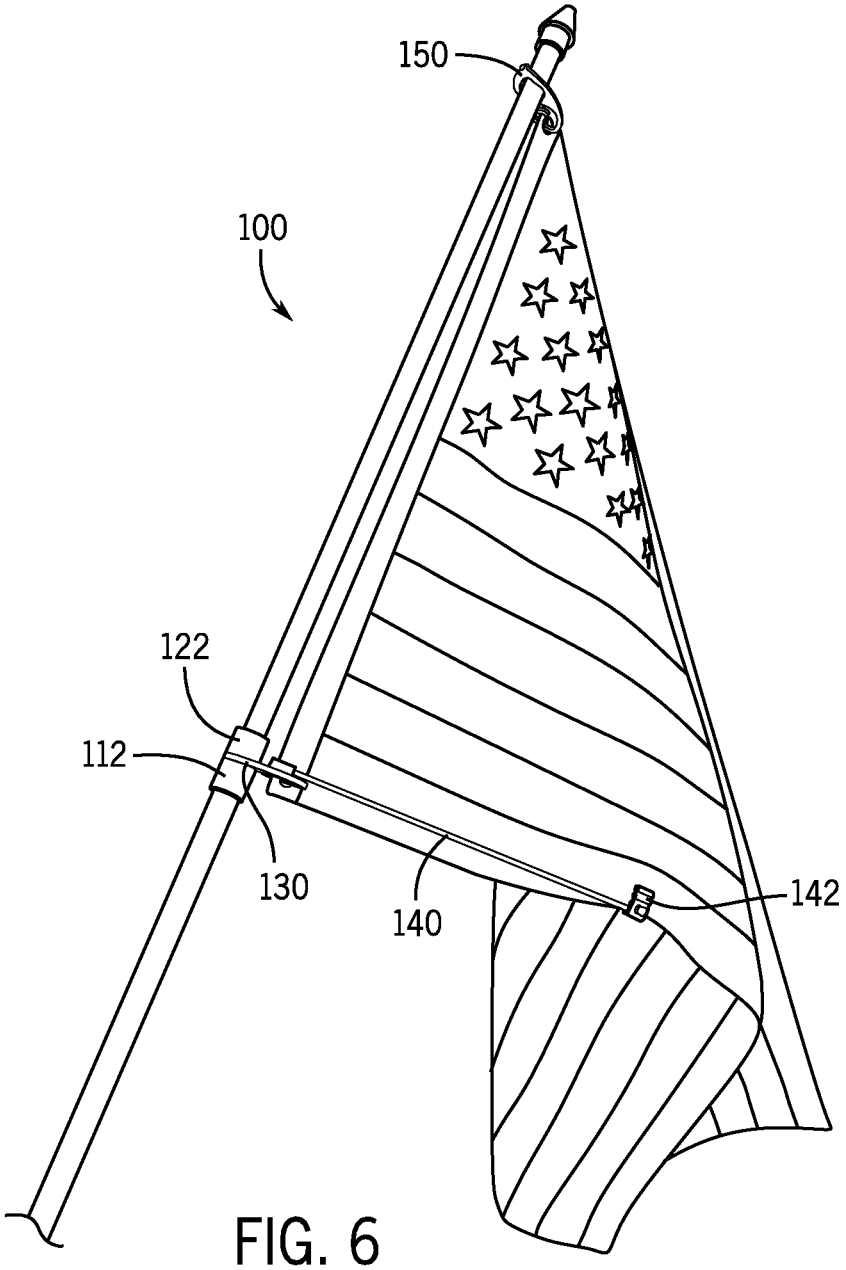
FIG. 6. is perspective view of an embodiment of the present invention in use.

Turning to FIG. 6. a perspective view of an embodiment of the present invention in use is shown.

While the present invention has been described above in terms of specific embodiments, it is to be understood that the invention is not limited to these disclosed embodiments. Many modifications and other embodiments of the invention will come to mind of those skilled in the art to which this invention pertain, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A flag demonstration apparatus comprising:

a flagpole further comprising a bottom portion and a top portion;

a lower swivel bracket including a rod and a flag hook comprising a base, a hook, and a rod socket; and an upper bracket removably attached to the top portion;

wherein the base is located on one side of the flag hook while the hook is located on the other side of the flag hook and the rod socket is affixed to the top or bottom surface of the flag hook and configured to receive one end of the rod, the lower swivel bracket is rotatably attached to the flagpole and configured to rotate about the flagpole less than 360 degrees.

2. The apparatus of claim 1 wherein the bottom portion further comprises a pin in movable communication with the lower swivel bracket.

3. The apparatus of claim 1 wherein the top portion and bottom portion are configured to removably attach together.

4. The apparatus of claim 1 further comprising a finial attached to the top portion.

5. The apparatus of claim 1 wherein the flagpole further comprises:

a circular ridge on a first fastening end of the bottom portion; and a post on a second fastening end of the top portion;

wherein the post is configured to screw into the circular ridge.

6. The apparatus of claim 5 wherein the first fastening end of the bottom portion further comprises a notch.

7. The apparatus of claim 1 wherein the upper bracket further comprises an upper bracket base and a hook.

8. The apparatus of claim 1 wherein the lower swivel bracket further comprises:

a flag hook;

a rod;

a clamp; and a clamp screw;

wherein the flag hook is fixed to one end of the rod and the clamp is fixed to the other end of the rod while the clamp screw is removably attached to the clamp.

9. The apparatus of claim 8 wherein the clamp and clamp screw are configured to securely hold a portion of a flag.

10. The apparatus of claim 1 wherein the base further comprises:

An aperture formed therethrough; and a canal formed therethrough;

wherein the aperture is located centrally in the base and the canal is located between the aperture and the top edge of the base.

11. The apparatus of claim 10 wherein the canal is semi-circular and shape.

12. A flag demonstration system comprising:

a flag with at least two grommets;

a flagpole further comprising a bottom portion with a first fastening end and a first terminating end and a top portion with a second fastening end and a second terminating end;

a lower rotatable bracket comprising a rod and a flag hook including a base, a hook, and a rod socket and is sandwiched between the first fastening end and the second fastening end; and an upper bracket attached to the second terminating end;

wherein the upper bracket is removably attached to one grommet of the flag and the lower rotatable bracket is removably attached to the second grommet of the flag and a portion of the flag, the lower rotatable bracket is configured to rotate about the flagpole less than 360 degrees.

13. A flag demonstration apparatus comprising:

a flagpole comprising a bottom portion and a top portion;

an upper bracket removably attached to the top portion and configured to attach to a flag; and a lower swivel bracket rotatably attached to the flagpole and configured to attach to the flag and display at least a portion of the flag, wherein the lower swivel bracket further comprises a canal which allows the lower swivel bracket to rotate about the flagpole 180 degrees or less.

* * * * *